US007896275B2

(12) United States Patent
Kjærsgaard

(10) Patent No.: US 7,896,275 B2
(45) Date of Patent: Mar. 1, 2011

(54) COMMINUTION PLANT

(75) Inventor: Johannes Kjærsgaard, Vejle Ø (DK)

(73) Assignee: M & J Industries A/S, Horsens (DK)

( * ) Notice: Subject to any disclaimer, the term of this patent is extended or adjusted under 35 U.S.C. 154(b) by 0 days.

(21) Appl. No.: 11/916,974

(22) PCT Filed: Jun. 22, 2006

(86) PCT No.: PCT/IB2006/052024

§ 371 (c)(1),
(2), (4) Date: May 20, 2008

(87) PCT Pub. No.: WO2006/137033

PCT Pub. Date: Dec. 28, 2006

(65) Prior Publication Data

US 2008/0272219 A1 Nov. 6, 2008

(30) Foreign Application Priority Data

Jun. 22, 2005 (DK) ..... 2005 00913

(51) Int. Cl.
*B02C 18/18* (2006.01)

(52) U.S. Cl. ..... 241/243

(58) Field of Classification Search ..... 241/236, 241/243

See application file for complete search history.

(56) References Cited

U.S. PATENT DOCUMENTS 4,142,688 A * 3/1979 Johnson et al. ..... 241/236
4,355,766 A * 10/1982 Wigand ..... 241/222
4,953,794 A * 9/1990 Paoli ..... 241/24.16
5,048,764 A * 9/1991 Flament ..... 241/36
5,639,035 A * 6/1997 Maugle et al. ..... 241/236
5,992,777 A * 11/1999 Aagaard ..... 241/236
6,092,751 A 7/2000 Kottmann ..... 241/166
7,213,778 B2 * 5/2007 Astafan et al. ..... 241/73
7,237,739 B2 * 7/2007 Kock ..... 241/243

(Continued)

FOREIGN PATENT DOCUMENTS

AU 81-33 915/78 11/1981

(Continued)

OTHER PUBLICATIONS

International Search and Preliminary Report for PCT/IB2006/052024.

*Primary Examiner*—Faye Francis
(74) *Attorney, Agent, or Firm*—Winston & Strawn LLP

(57) ABSTRACT

A comminution plant for comminuting material includes a set of fixed bottom knifes separated by parallel opening, two parallel shafts extending crosswise of the openings, a set of upper knifes attached on respective shafts and extending partly into the openings, and at least one drive assembly for rotating the shafts during operation. The upper knifes on one shaft include first and second knifes with the second one having a diameter which is smaller than the first. The upper knifes on the other shaft includes third and fourth knifes with the fourth one having a diameter which is smaller than the third. The diameters of the first and third knives are of a size which is larger than twice the distance between the axes of rotation of the at least two shafts. The comminution plant according to the invention can comminute a material effectively and to high degree of fineness.

12 Claims, 2 Drawing Sheets

U.S. PATENT DOCUMENTS

Figure 1:
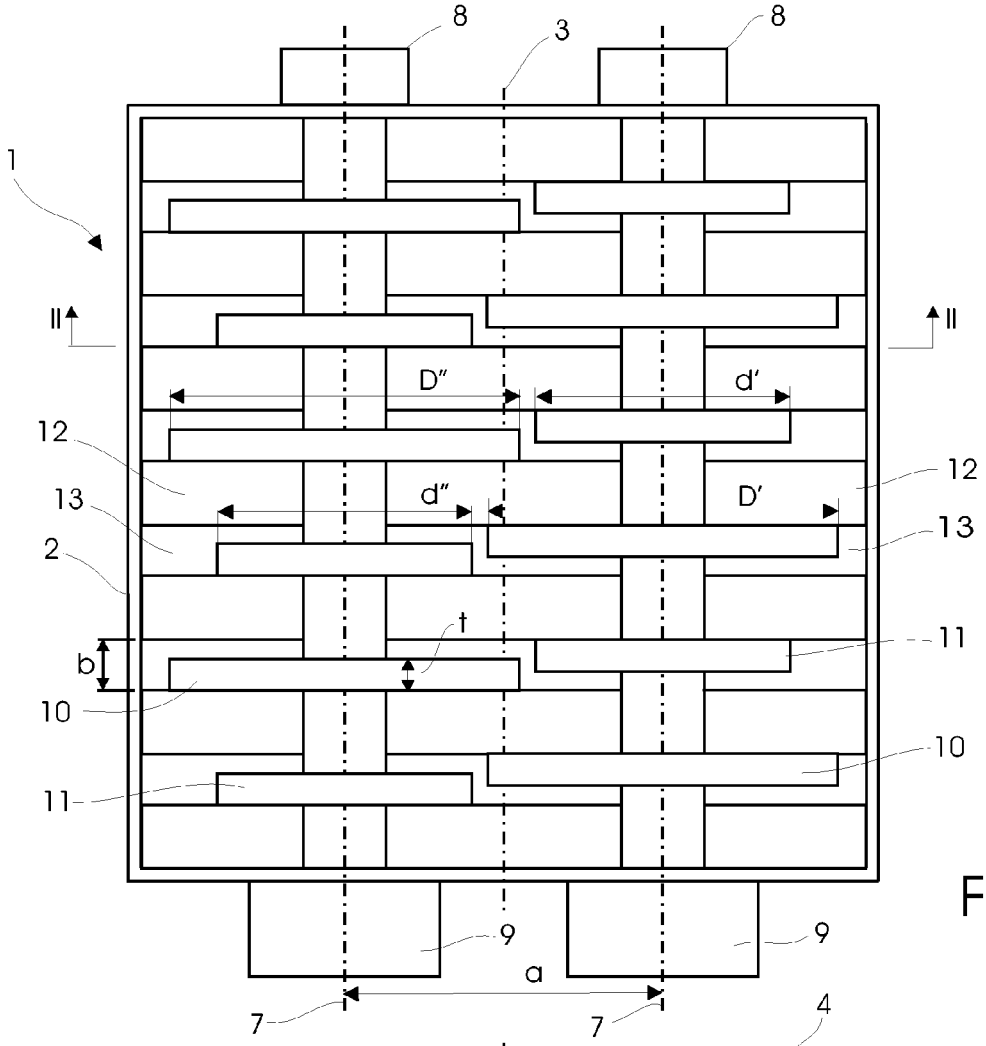

| | | | | |
|---|---|---|---|---|
| 7,677,483 | B2 * | 3/2010 | Romanovich et al. | 241/100 |
| 2003/0230657 | A1 * | 12/2003 | Dorscht | 241/243 |

FOREIGN PATENT DOCUMENTS

| | | | |
|---|---|---|---|
| DE | 28 31 953 | A1 | 12/1979 |
| DE | 102 47 281 | B3 | 3/2004 |
| DE | 103 24 368 | A1 | 11/2004 |
| EP | 0 037 036 | B1 | 10/1984 |
| EP | 0 521 081 | B1 | 9/1994 |
| EP | 0 928 222 | B1 | 7/1999 |
| WO | WO 91/14501 | | 10/1991 |
| WO | WO 97/10057 | | 3/1997 |
| WO | WO 2005/039774 | A1 | 5/2005 |

* cited by examiner

COMMINUTION PLANT

The invention relates to a comminution plant of the kind serving for comminution of materials and comprising at least one set of fixed bottom knifes separated by openings, at least two parallel shafts extending crosswise of the bottom knifes, a set of upper knifes attached on each shaft, the knifes are extending partly into the openings between the bottom knives, and at least one drive assembly for rotating the shaft during operation.

Comminution plants are in some cases large and powerful plants for comminution of relatively large and heavy materials of any kind, such as e.g. discarded household goods, tires, furniture, carpets, waste wood, and demolition timber, but they can in other cases be relatively small plants for comminution of small material, such as e.g. paper.

There are comminution plants that only have one shaft. However, the comminution plants employed the most have two shafts and bottom knifes separated by openings, each accommodating a part of an upper knife from each shaft. Thereby, the comminution obtains a relatively short overall length and a relatively high capacity.

From the applicant's U.S. Pat. No. 5,992,777 which is incorporated by reference in the present application is known a continuation plant having two shafts on which are mounted opposite upper knifes overlapping each other. Therefore, the openings between two bottom knifes cannot be narrower than twice the thickness of an upper knife. This means that the openings are relatively wide, and that the comminution of the material therefore is similarly coarse.

A finer comminution of material can take place by bending the bottom knifes of the known comminution plant but this is at the expense of the strength of the bottom knife construction. The bent bottom knife will furthermore be difficult and costly to maintain.

A higher degree of fineness can also be obtained by arranging a comminution plant with opposite upper knifes that on the contrary do not overlap each other. The openings between the two bottom knifes can then be narrower than the total thickness of two upper knifes, and the comminution of the material will therefore be equally fine. However, it is a disadvantage that a space is left between the two sets of upper knifes, in which space e.g. plate-shaped material is not comminuted, and this material might therefore remain in this space and block the comminution of other material.

A comminution plant having two shafts on which opposite upper knifes are mounted that do not overlap each other is known from the applicant's European Patent No. 0 521 081 which is incorporated by reference in the present application.

The disadvantages of the above known comminution plants are remedied according to the invention by in a first aspect providing a comminution plant of the kind mentioned in the opening paragraph, that can comminute a material to a relatively high degree of fineness, in a second aspect providing a comminution plant of the kind mentioned in the opening paragraph, that has a strong bottom knife construction, in a third aspect providing a comminution plant of the kind mentioned in the opening paragraph, that has a bottom knife construction which is easy to maintain, in a fourth aspect providing a comminution plant of the kind mentioned in the opening paragraph, that has a bottom knife construction which has a long life, in a fifth aspect providing a comminution plant of the kind mentioned in the opening paragraph, that has shafts rotatable at the least possible moment in relation to the capacity of the plant, in a sixth aspect providing a comminution plant of the kind mentioned in the opening paragraph, that effectively can comminute the material, and in a seventh aspect providing a comminution plant of the kind mentioned in the opening paragraph, that has a relatively high capacity with a shorter overall length than hitherto known.

The novel and unique feature according to the invention is the fact that the upper knifes on one of the at least two shafts comprise at least one first upper knife having a first diameter and at least one second upper knife having a second diameter smaller than the first diameter, that the upper knifes on another of the at least two shafts comprise at least a third upper knife having a third diameter and at least a fourth upper knife having a fourth diameter smaller than the third diameter, and that the first and third diameters together are of a size that is larger than twice the spacing between the axis of rotation of the at least two shafts.

Thereby, it is obtained that e.g. plate-shaped material is comminuted by the overlapping first and third upper knifes. Thus, there is no through-going spacing between the two sets of upper knifes, in which such material would be able to remain and block the comminution of other material. Still, the first and third upper knifes cannot extend into the same opening if this is to be relatively narrow and the comminution similarly fine.

However, a fine comminution can be obtained if the sum of the dimensions of the first—and fourth diameters and the second—and third diameters, respectively, is less than twice the spacing between the axis of rotation of the at least two shafts, and that a first set of upper knifes including first and fourth upper knifes and a second set of upper knifes including second and third upper knifes extend down into respective openings between two bottom knife.

Therefore, the two upper knifes extending down into the same opening between two bottom knifes do not overlap each other, and the width of the opening can therefore be smaller than the sum of the thickness of the two upper knifes, whereby the comminution plant according to the invention is able to comminute a material at a relatively high degree of fineness.

If the first and second sets of upper knifes alternately extend down into respective openings between two bottom knifes, it is simultaneously obtained that e.g. plate-shaped material that tends not to be comminuted by the first and/or second sets of upper knifes is comminuted by the first and third sets of upper knifes.

If the width of the openings is larger than the thickness of the upper knifes, the two upper knifes in every set of upper knifes extending down into the same opening will furthermore be axially displaced in the opening, whereby the material is comminuted in both a cutting and breaking operation.

The comminution operation will be especially effective if the two upper knifes are in contact with or close to their respective bottom knifes of the two bottom knifes defining the respective opening.

The term "close to" means a spacing of a size allowing an upper knife and an associated bottom knife to concurrently perform a cutting operation on the material to be comminuted.

In this case, both bottom knifes are exposed to wear but primarily in the cutting areas in contact with or close to the respective upper knife. By letting the shafts and their upper knifes change places in the comminution plant, the advantage is obtained in that it is now the still unworn cutting areas that are exposed to wear, whereby the life of the bottom knifes is extended.

In an especially simple embodiment of the comminution plant according to the invention, the first and third diameters can be equal, and the second and fourth diameters can also be equal. Thereby, the costs for manufacturing the comminution plant are reduces substantially.

The comminution plant according to the invention can furthermore comprise partly a centrally located set of bottom knifes separated by openings into which the first and second sets of upper knifes are extending, partly a peripheral set of bottom knifes separated by openings into which only one upper knife is extending.

Thereby, the comminution plant is given a relatively short overall length and at the same time a high capacity, as the peripheral sets of bottom knifes participate in the comminution process to a greater or lesser extent.

The openings between the peripheral bottom knifes can advantageously have the same width as the openings between the central bottom knifes so that the material in the range of the peripheral knifes is comminuted to the same degree of fineness as in the range of the central bottom knifes. Alternatively, the peripheral openings can be narrower than the central openings, and comminution will therefore be correspondingly finer.

Figure 2:
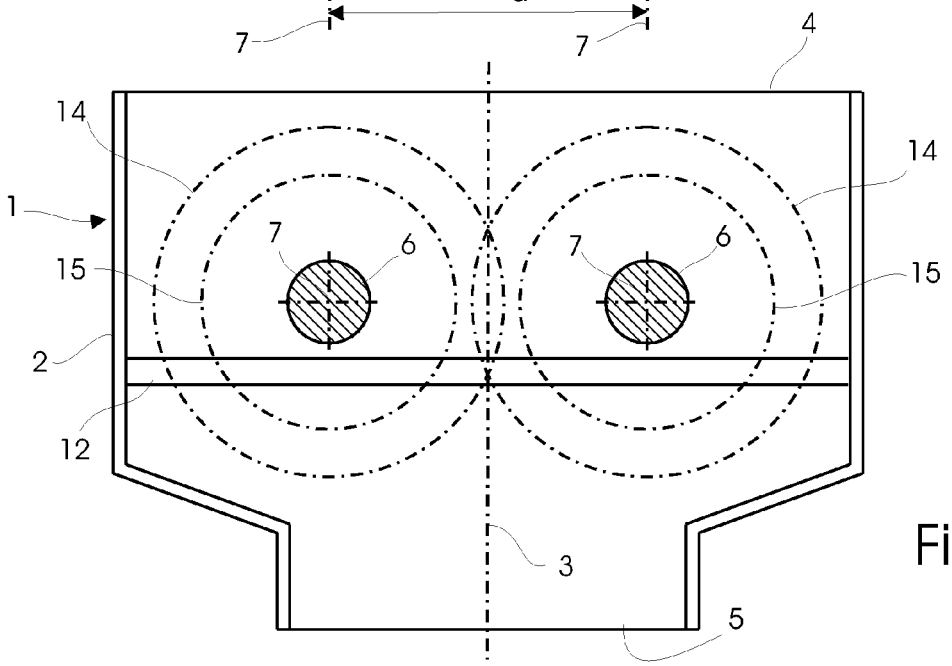

The invention will be explained in greater details below, describing only exemplary embodiments with reference to the drawing, in which FIG. 1 is a plan view of a first embodiment of a comminution plant according to the invention, FIG. 2 is a diagrammatic sectional view taken along the line I-I of FIG. 1.

Figure 3:
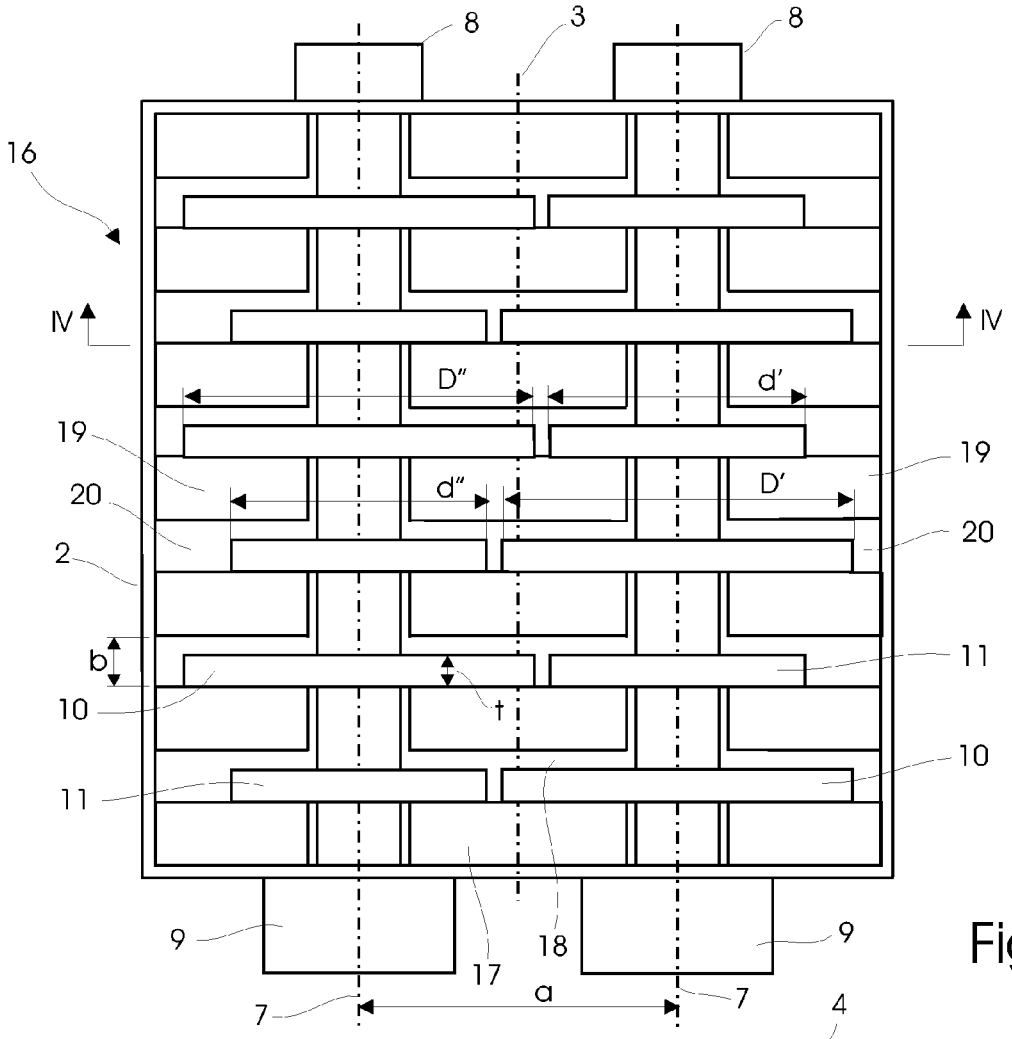
Figure 4:
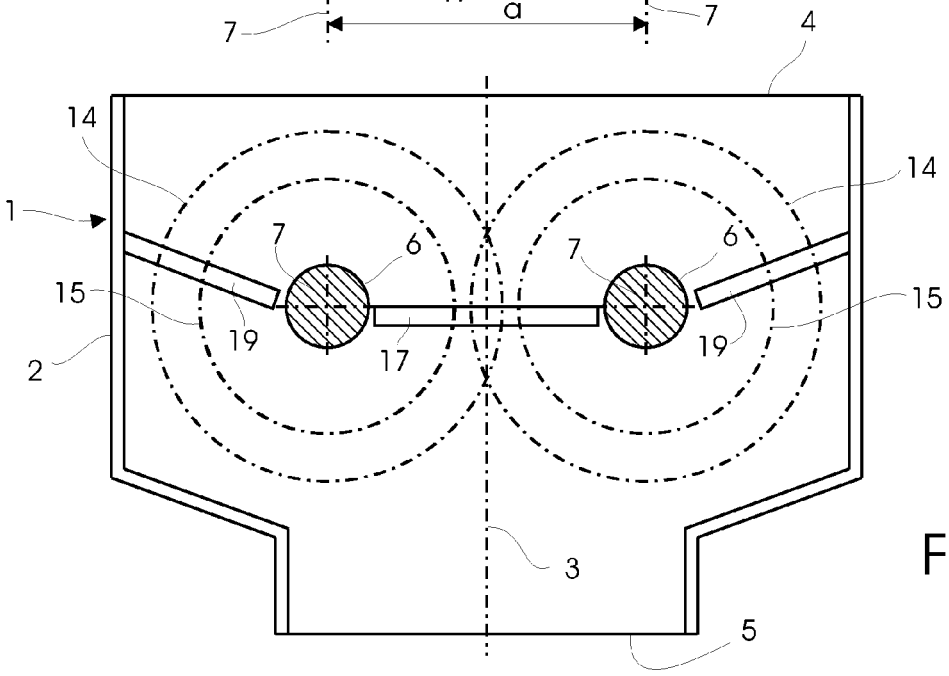

FIG. 3 is a plan view of a second embodiment of a comminution plant according to the invention, and FIG. 4 is a diagrammatic sectional view taken along the line IV-IV in FIG. 3.

The comminution plant in FIGS. 1 and 2, which is generally designated by the reference numeral 1, comprises a preferably funnel-shaped housing 2 defining a central axis 3 and having an upper inlet opening 4 for the material (not shown) to be comminuted and a bottom outlet opening 5 for the comminuted material (not shown).

On either side of the central axis 3, two, in this case, mainly identical shafts 6 having axes of rotation 7 parallel to the central axis 3 are mounted in the house 2 rotatably with a mutual spacing a.

At one end of the housing, each shaft is journaled in a bearing 8, and at the other end in a drive assembly 9 for rotating the respective shaft in e.g. the way stated in the applicant's patent EP 0 521 081 or in another way.

In the case shown, three large, mainly disc-shaped upper knifes 10 and three small, mainly disc-shaped upper knifes 11 are alternately attached on each shaft. In the case shown, all disc-shaped upper knifes have the thickness t. In this connection, the expressions "large" and "small" mean that the upper knifes 10 and 11 do not have equally large diameters D', D". As desired, the difference can be greater or lesser.

The given number of three large and three small, respectively, upper knifes on each shaft is only to be taken as an example, as more or less upper knifes than the number given above can be mounted on each shaft within the scope of the invention.

Furthermore, all the large upper knifes 10 on both shafts have, in the case shown, the same diameter and all the small upper knifes 11 also have the same diameter, whereby the costs for manufacturing the comminution plant are reduced. The moments for rotating the two shafts with their knifes during operation will furthermore be mainly equally large and therefore smaller than if the respective upper knifes of the two shafts are not of the same size.

In the case shown, a total number of seven fixed bottom knifes 12 are also located in the housing for comminuting the material in cooperation with the upper knifes that are rotating in operation. Two adjacent bottom knifes 12 are separated by an opening 13 of a width b.

Both the large and the small upper knifes are provided with teeth (not shown) that can be shaped in any appropriate way, for example as stated in the applicant's EP 0521 081 and U.S. Pat. No. 5,992,777. The shape of the teeth is not a part of the present invention, and the outer outline 14 and 15 of the upper knifes 10 and 11 have therefore only been shown schematically in dotted lines 14 and 15 in FIG. 2.

As shown in FIG. 2, the upper knifes 10 and 11 are extending partly down into the openings 13 between the bottom knifes 12.

A first pair of upper knifes 10,11 comprising one large and one small upper knife 10, 11 on the right and left shafts, respectively, seen in FIG. 1, and a second pair of upper knifes 11, 10 comprising one small and one large upper knife 11,12 on the left and right shafts, respectively, seen in FIG. 1, are extending alternately down into each respective opening 13 between two bottom knifes 12.

In an exemplary embodiment, the construction of the comminution plant according to the invention satisfies the following criteria.

$$D+d<2a \quad 1.$$

$$2D>2a \quad 2.$$

$$b<2t \quad 3.$$

The first criterion means that the first and second pairs of upper knifes 10,11 and 11,10 do not overlap each other, whereby the third criterion can be met with the advantageous result that the comminution of a material will be relatively fine.

The second criterion means that the large upper knifes 10 of the two shafts overlap each other and therefore comminute e.g. plate-shaped material during operation, the material is thereby effectively kept from remaining between two sets of upper knifes and block the comminution of another material.

However, it is noted that the scope of protection of the invention is not limited to comprising the third criterion but can, in a second embodiment, comprise the criterion b>2t.

In FIG. 1, it is seen that the upper knifes in a pair of upper knifes 10,11 or 11,10 extending down into an opening 13 between two bottom knifes 12, are contacting or are close to a cutting area on each respective bottom knife. This cutting area will obviously be worn substantially during operation.

On replacement of the shafts and their associated upper knifes, the upper knifes are made to contact or be close to the still unworn cutting areas on the bottom knifes. During operation, it is now these cutting areas that are worn. Thereby, the life of the bottom knifes are doubled or at least prolonged significantly.

Another of the advantages obtained according to the invention is that e.g. plate-shapes material to be comminuted frequently will not rest on both the large and small upper knifes but only on the large upper knifes. Thereby, the surface pressure between the material and the upper knifes is halved, and the upper knifes will therefore initially be able to process and/or pass through the material more easily.

The teeth (not shown) on the large and small upper knifes furthermore cut through the material at different speeds and thereby different force applications and at the same time at different radial distances from the axis of rotation. This has the effect that the material, especially in the working area, is affected by axial torsion moments which advantageously facilitate the comminution of the material.

FIGS. 3 and 4 show a second exemplary embodiment of a comminution plant according to the invention. This comminution plant mainly corresponds to the comminution plant in FIGS. 1 and 2 and it mainly functions in the same way. Like parts are therefore designated by the same reference numerals.

This comminution plant 16 is mainly constructed in the same way as stated in the applicant's patent U.S. Pat. No. 5,992,777, that is with a centrally located set of bottom knifes 17 separated by openings 18 into which the first and second sets of upper knifes 10,11 or 11,10 are extending and two sets of peripheral bottom knifes 19 separated by openings 20 into which only one of the upper knifes 10 or 11 is extending.

The top face of the bottom knifes extends in a direction intersecting the axis 7 of the respective shaft 8 but can alternatively extend in a direction intersecting an area close to this. Thereby, the teeth (not shown) of the upper knifes will attack the material at an advantageous angle of attack.

As shown in FIG. 4, the central set of bottom knifes 17 are horizontal in the case shown, whereas the peripheral bottom knifes 19 incline down toward the central bottom knifes 17 to thereby advantageously guide the material (not shown) to be comminuted in towards the central bottom knifes.

The upper knifes 10 and 11 extending down into an opening 18 and 20 between two central bottom knifes 17 and two peripheral knifes 19, respectively, contact or are close to a cutting area on one of the two bottom knifes 17 and 19. This cutting area on the two bottom knifes 17 and 19 is exposed to wear during operation.

Parallel displacement of the two shafts 6 or the upper knifes 10 and 11 on these will displace the cutting area to the opposite bottom knifes 17 and 19. During operation, it will now be these cutting areas that are worn, whereby the life of the bottom knifes are doubled or at least prolonged significantly.

The invention is described above and shown in the drawing on the assumption that each upper knife contact or is close to a bottom knife.

Within the scope of the invention, each upper knife can however be located at a distance from each of the bottom knifes that define an opening into which the upper knife in question is extending.

The comminution plant according to the invention can furthermore comprise more than two shafts with associated upper knifes.

The diameters of the large and small upper knifes on one shaft need not be of the same size as the large and small upper knifes on another shaft either.

Furthermore, the large upper knifes on the same shaft need not be of the same size and neither do the small knifes.

The upper knifes on each shaft can furthermore be mounted in such a way that their teeth (not shown) describe an axially extending spiral to thereby be able to reduce the energy used to comminute the material.

The invention claimed is:

1. A comminution plant for comminuting material and comprising at least one set of fixed bottom knifes separated by openings, at least two parallel shafts extending crosswise of the bottom knifes, a set of upper knifes attached on each shaft, with the upper knifes extending partly into the openings between the bottom knives, and at least one drive assembly for rotating the shafts during operation, wherein the upper knifes on one of the at least two shafts comprise at least one first upper knife having a first diameter and at least one second upper knife having a second diameter which is smaller than the first diameter, that the upper knifes on another of the at least two shafts comprise at least one third upper knife having a third diameter and at least one fourth upper knife having a fourth diameter which is smaller than the third diameter, and that the first diameter and third diameter together are of a size which is larger than twice the distance between the axes of rotation of the at least two shafts, wherein the sum of the sizes of the first diameter and the fourth diameter and of the second diameter and third diameter, respectively, is less than twice the distance between the axes of rotation of the at least two shafts.

2. The comminution plant according to claim 1, wherein a first set of upper knifes with a first and fourth upper knife and a second set of upper knifes with a second and third upper knife are extending down into respective openings between two bottom knifes.

3. The comminution plant according to claim 2, wherein the upper knifes do not overlap each other so that the openings can be minimized to facilitate the comminution of the material to a relatively high degree of fineness.

4. The comminution plant according to claim 1, wherein the upper knifes in every set of upper knifes are in contact with or close to their respective bottom knife of the two bottom knifes defining an opening into which the respective set of upper knifes is extending.

5. The comminution plant according to claim 1, wherein the width (b) of at least one opening between two bottom knifes is smaller than the total thickness (t) of a first and fourth upper knife and a second and third upper knife, respectively.

6. The comminution plant according to claim 1, wherein the upper knifes are mainly disc-shaped and of the same thickness t and the openings are of the same width b wherein $b<2t$.

7. The comminution plant according to claim 1, wherein the first and second sets of upper knifes alternately extend down into respective openings between two bottom knifes.

8. The comminution plant according to claim 1, wherein the upper knifes in every set of upper knifes are displaced axially in relation to each other.

9. The comminution plant according to claim 1, wherein the first diameter and third diameter are of the same size, and that the second diameter and fourth diameter are of the same size.

10. The comminution plant according to claim 1, which partly comprises a centrally located set of bottom knifes separated by openings is into which the first or second sets of upper knifes are extending, and a peripheral set of bottom knifes separated by openings into which only one upper knife is extending.

11. The comminution plant according to claim 1, wherein the upper knifes initially process or pass through the material more easily utilizing axial torsion moments while also extending the wear life of bottom knives.

12. A comminution plant for comminuting plate-shaped material and comprising at least one set of fixed bottom knifes separated by openings, at least two parallel shafts extending crosswise of the bottom knifes, a set of upper knifes attached on each shaft, with the upper knifes extending partly into the openings between the bottom knives, and at least one drive assembly for rotating the shafts during operation, wherein the upper knifes on one of the at least two shafts comprise at least one first upper knife having a first diameter and at least one second upper knife having a second diameter which is smaller than the first diameter, that the upper knifes on another of the at least two shafts comprise at least one third upper knife having a third diameter and at least one fourth upper knife having a fourth diameter which is smaller than the third diameter, and that the first diameter and third diameter together are of a size which is larger than twice the distance between the axes of rotation of the at least two shafts, wherein the sum of the sizes of the first diameter and the fourth diameter and of the second diameter and third diameter, respectively, is less than twice the distance between the axes of rotation of the at least two shafts, so that the upper knifes initially process or pass through the plate-shaped material more easily utilizing axial torsion moments while also extending the wear life of bottom knives; wherein a first set of upper knifes with a first and fourth upper knife and a second set of upper knifes with a second and third upper knife are extending down into respective openings between two bottom knifes and the upper knifes do not overlap each other so that the openings can be minimized to facilitate the comminution of the material to a relatively high degree of fineness.

* * * * *